US010310421B1

(12) United States Patent
Buchanan

(10) Patent No.: US 10,310,421 B1
(45) Date of Patent: Jun. 4, 2019

(54) FUSER ASSEMBLY HAVING NIP REDUCTION FORCE FOR IMAGING DEVICE

(71) Applicant: LEXMARK INTERNATIONAL, INC., Lexington, KY (US)

(72) Inventor: Jeffery James Buchanan, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/832,830

(22) Filed: Dec. 6, 2017

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/2032
See application file for complete search history.

(56) References Cited

U.S. PATENT DOCUMENTS 6,125,256 A 9/2000 Ni
7,003,246 B2 2/2006 Gogate
2006/0002737 A1* 1/2006 Shinshi ..... G03G 15/2035 399/122
2008/0181686 A1 7/2008 Geyling
2008/0310895 A1* 12/2008 Masuda ..... G03G 15/2064 399/331
2009/0232549 A1 9/2009 Foster
2011/0170920 A1* 7/2011 Fujiwara ..... G03G 15/2064 399/331
2012/0082478 A1* 4/2012 Wang ..... G03G 21/1633 399/110
2017/0090373 A1* 3/2017 Hashimoto ..... G03G 15/2028

OTHER PUBLICATIONS

Pictures of Fuser Bellcrank; Samsung Printer Model: XPRESS M3015DW; 2pp.;printer publicly available at least as of application filing date Dec. 6, 2017.

* cited by examiner

*Primary Examiner* — Rodney A Bonnette

(57) ABSTRACT

A fuser assembly includes a heated member and backup member forming a fusing nip. A nip loading spring biases into contact the backup member and the heated member. A bellcrank contacts the nip loading spring such that upon opening of an access door of the imaging device, the bellcrank acts on the nip loading spring to reduce a force between the backup member and the heated member but keeping in contact the backup member and the heated member. The bellcrank typifies a wire or other flexible lever. A cam pivots as the access door opens and engages the wire to compress the nip loading spring during use.

19 Claims, 7 Drawing Sheets

FUSER ASSEMBLY HAVING NIP REDUCTION FORCE FOR IMAGING DEVICE

FIELD OF THE INVENTION

The present disclosure relates to a fuser assembly in an imaging device. The assembly includes a heated and backup member forming a fusing nip. The disclosure relates further to reducing the force of the nip to minimize wrinkling when imaging media, such as envelopes.

BACKGROUND

In an electrophotographic (EP) imaging process used in printers, copiers and the like, a photosensitive member, such as a photoconductive drum or belt, is uniformly charged over an outer surface. An electrostatic latent image is formed by selectively discharging the surface and applying toner. The toner is transferred to media and is fixed by applying heat and pressure in a fuser assembly.

Fuser assemblies take many forms. They include hot rolls or belts that springs bias against a backup roll to form a fusing nip. The nip exerts a force on media traversing the nip, but the force is often too great when imaging smaller-sized media, such as envelopes, causing wrinkling. To overcome this, manufacturers introduce devices to remove the force of the springs acting on the nip. However, proximity of the rolls and belts, their relative hardness, their deflection, etc., sometimes does not provide sufficient enough relief in the nip force. Conversely, the removal of the spring force sometimes causes components to become so lax that a gap develops at the fusing nip eliminating sufficient force to even advance media through the nip. The inventor recognizes a need to overcome these and other problems.

SUMMARY

A fuser assembly includes a heated member and backup member forming a fusing nip. A nip loading spring biases into contact the two members. A bellcrank contacts the nip loading spring such that upon opening of an access door of the imaging device, the bellcrank acts on the nip loading spring to reduce a force between the backup member and the heated member but keeping in contact with one another the backup member and the heated member. The bellcrank typifies a wire or other flexible lever. A cam pivots as an access door to the imaging device opens and engages the wire to compress the nip loading spring with a predetermined force during use. The symmetry of the fuser assembly allows duplicate features on proximate and distal ends of the fusing nip. The introduction of a flexible bellcrank provides at least the advantage of keeping the force of the loading spring, albeit a reduced force, acting to keep in contact the heated and backup members. The members typify rolls or belts depending upon selection. The loading spring acts on a shaft of the backup member. The shaft defines the rotational axis of the backup member. Other designs are possible.

DETAILED DESCRIPTION OF THE EMBODIMENTS

Figure 1:
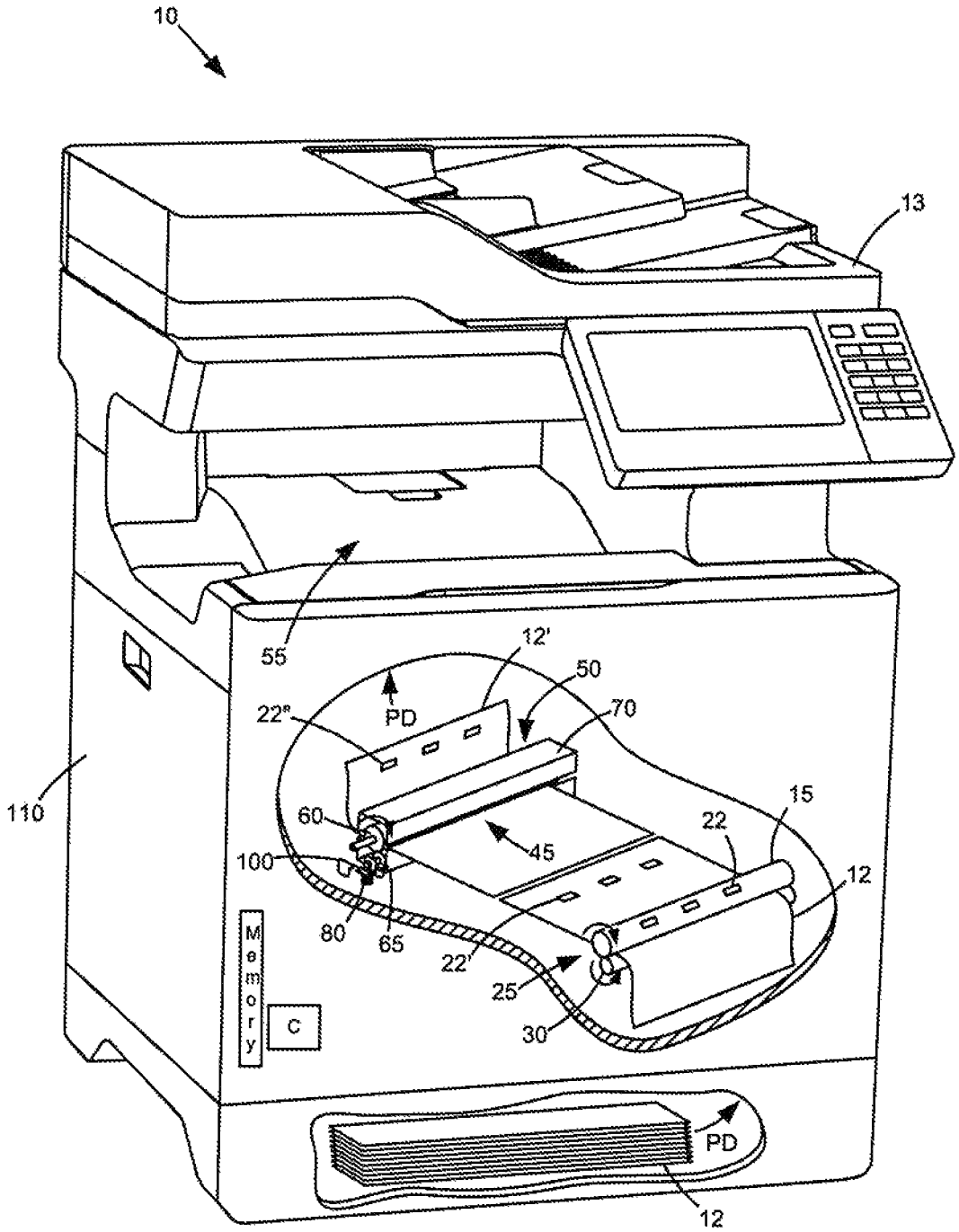
FIG. 1 is a diagrammatic view of an imaging device, including cutaway with exaggerated and simplified view of a fuser assembly.

With reference to FIG. 1, an electrophotographic imaging device 10 prints images on sheets of media 12. A controller (C), such as an ASIC(s), circuit(s), microprocessor(s), etc., receives image data from a scanner 13, computer, laptop, mobile device, etc. and controls hardware to convert it to printed data. The controller has access to a local or remote memory that stores parameters useful to conducting imaging operations.

During use, the controller (C) activates one or more laser or light sources (not shown) to selectively discharge areas of a photoconductive (PC) drum 15 to create thereon a latent image of the image data. Toner particles are applied to the latent image to form a toned image 22 on the PC drum 15. At a transfer nip 25 formed between the PC drum 15 and a transfer roll 30, for example, the toned image 22 is electrostatically transferred from the PC drum 15 to a media sheet 12 travelling in a process direction PD. The media sheet 12' with toned image 22' enters a fuser assembly 40 through its entrance 45 for application of heat and pressure to fix the toned image to the media sheet 12'. Media sheet 12' with fused toner image 22" exits the fuser assembly 40 through its exit 50 and is either deposited into an output media area 55 for collection by a user or enters a duplex media path for transport back to the PC drum 15 for imaging on the reverse side of the media sheet. The fuser assembly is disposed within a housing 70 for configuration as a customer replaceable unit for ease of maintenance. The housing includes a heated member 60 and backup member 65.

Figure 2:
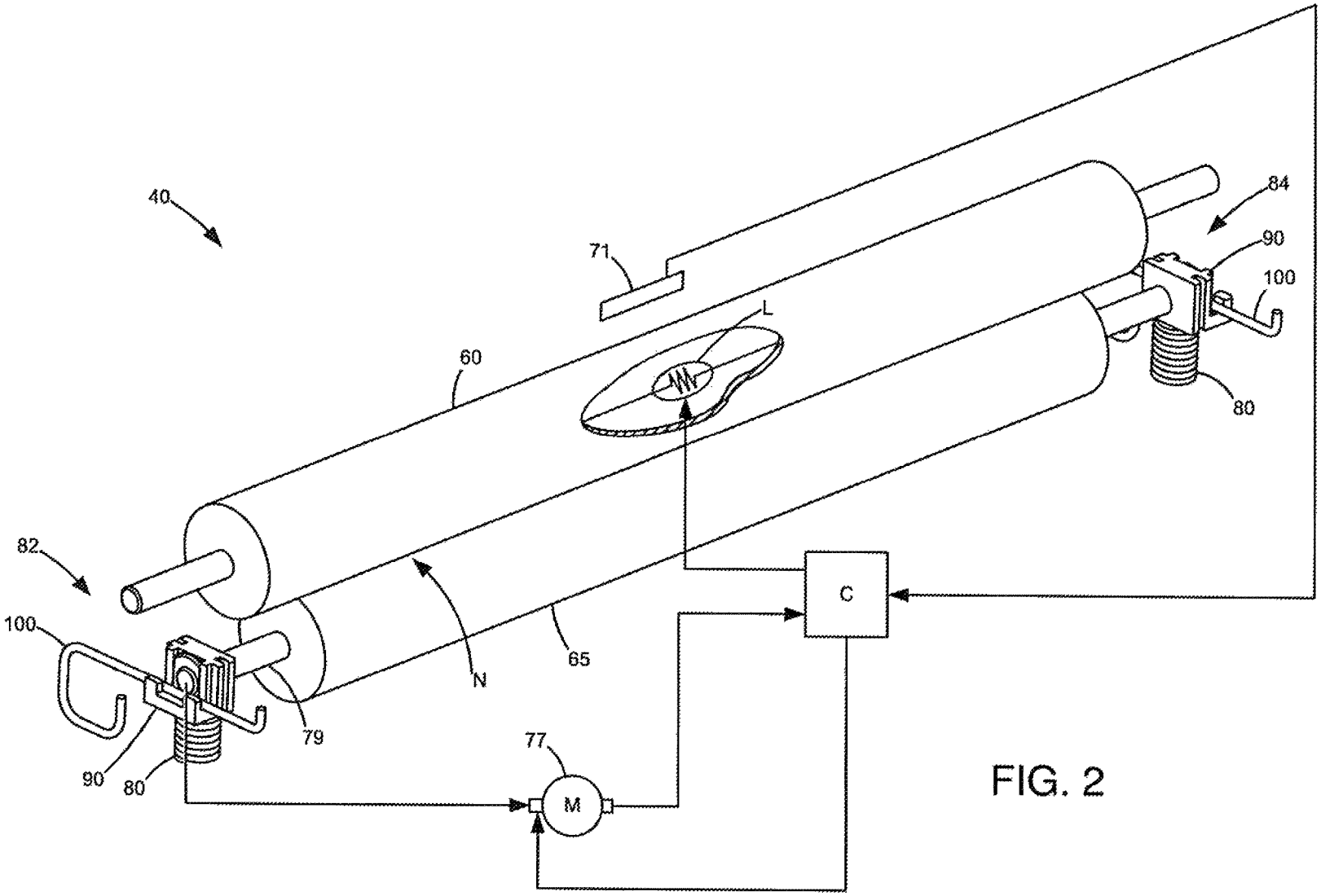
FIG. 2 is a diagrammatic view of a fusing nip.

As seen in FIG. 2, the heated member 60 and the backup member 65 form a fusing nip (N) to provide heat and pressure to fix toner to media. The heated member defines a hot roll, such as a metal core with coating(s) exhibiting good thermal mass, and a heating lamp (L) internal to the core, as is familiar. Alternatively, the heated member defines a polymeric belt with internal heating lamp or ceramic heater and resistive traces, as is also familiar. The backup member 65 typifies a microballoon (e.g., porous foam rubber) or liquid injection molding (LIM) rubber. The backup member 65 connects to a motor 77 via an integral shaft 79 and the motor turns the shaft to rotate the backup member. Rotation of the backup member, in turn, causes rotation of the heated member to convey media through the fusing nip in the process direction. Alternatively, the motor rotates the heated member, which causes rotation of the backup member. A controller C governs the speed of rotation in a feedback relationship with the motor. The controller also regulates the temperature of the heated member in feedback with one or more thermistors 71.

To maintain the pressure of the fusing nip N, a nip loading spring 80 applies upward pressure to the shaft 79 of the backup member 65. The spring 80 resides at both the proximal end 82 and distal end 84 of the backup member to maintain uniformity of force of the fusing nip throughout an axial length of the backup member during use. A fitting 90 connects to the shaft to allow rotation of the shaft and provide an attachment point for the spring 80 to connect thereto. A bellcrank 100 also attaches to the nip loading spring 80, preferably at fitting 90. The bellcrank serves to reduce the force of the fusing nip between the backup member and the heated member when fusing envelopes, for example, but otherwise keeping in contact with one another the two members 60, 65 by way of the force from the nip loading spring 80.

Figure 3A:
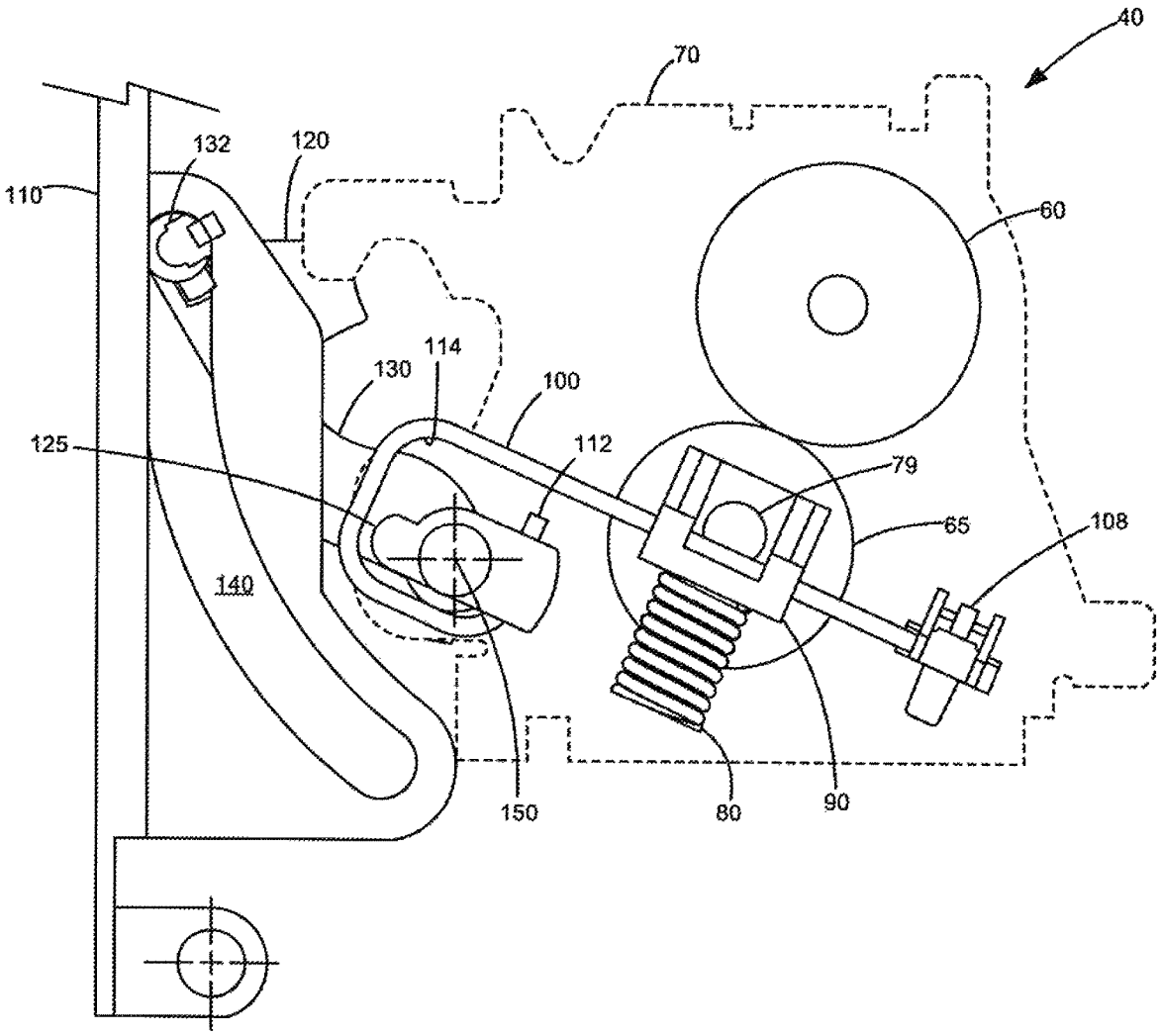
FIGS. 3A-3C are sequential views of a bellcrank acting on the fusing nip as an access door to the imaging device transitions from a closed, to intermediate, to open position, including a cam acting on the bellcrank.
Figure 3B:
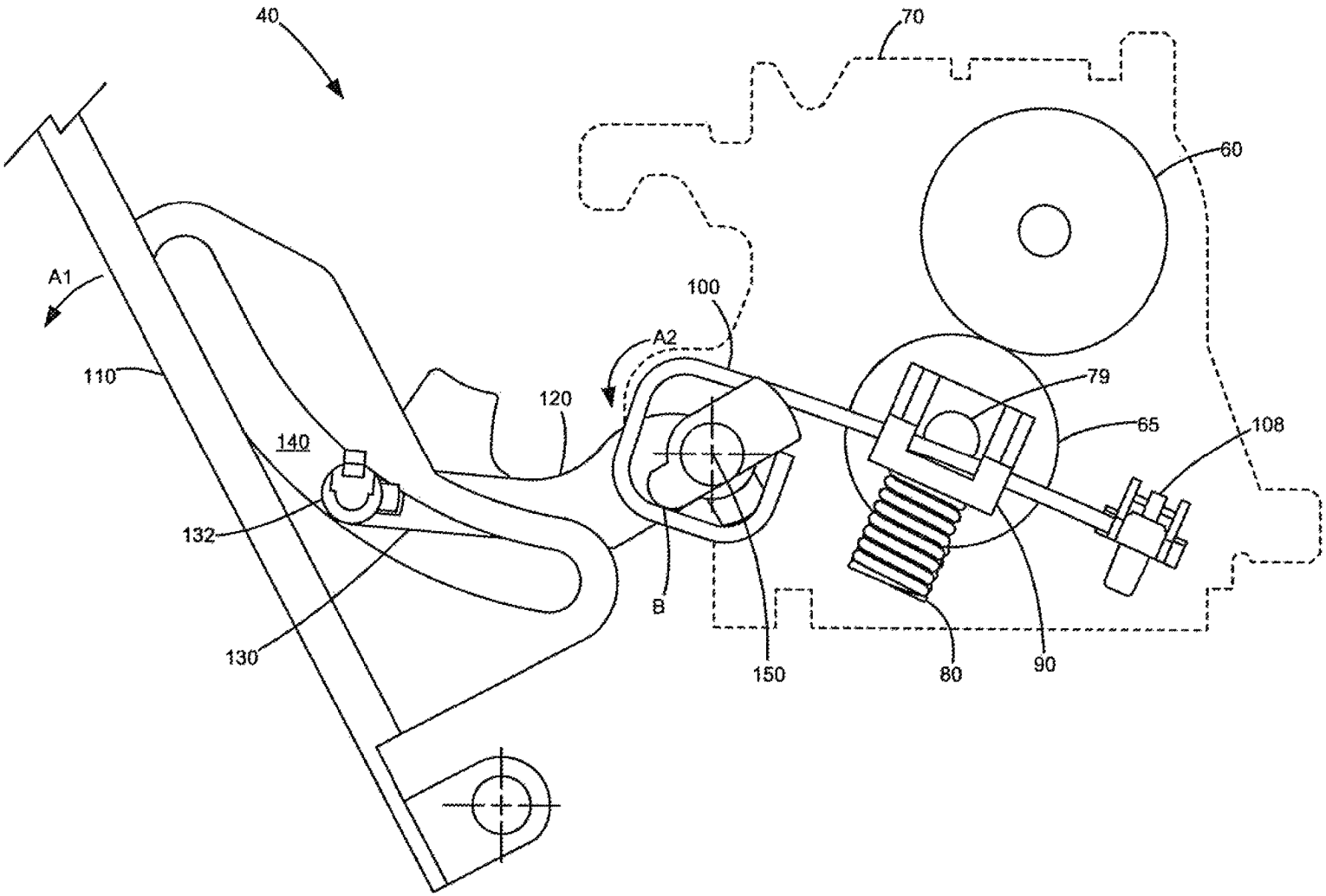

As illustrated in the sequential views of FIGS. 3A-3B, the bellcrank acts on the nip loading spring to compress the nip loading spring upon the opening of an access door 110 of the imaging device. In turn, the force exerted by the spring 80 on the shaft 79 of the backup member 65 becomes reduced, but not eliminated, thereby ensuring contact between the backup member and the heated member.

Figure 3C:
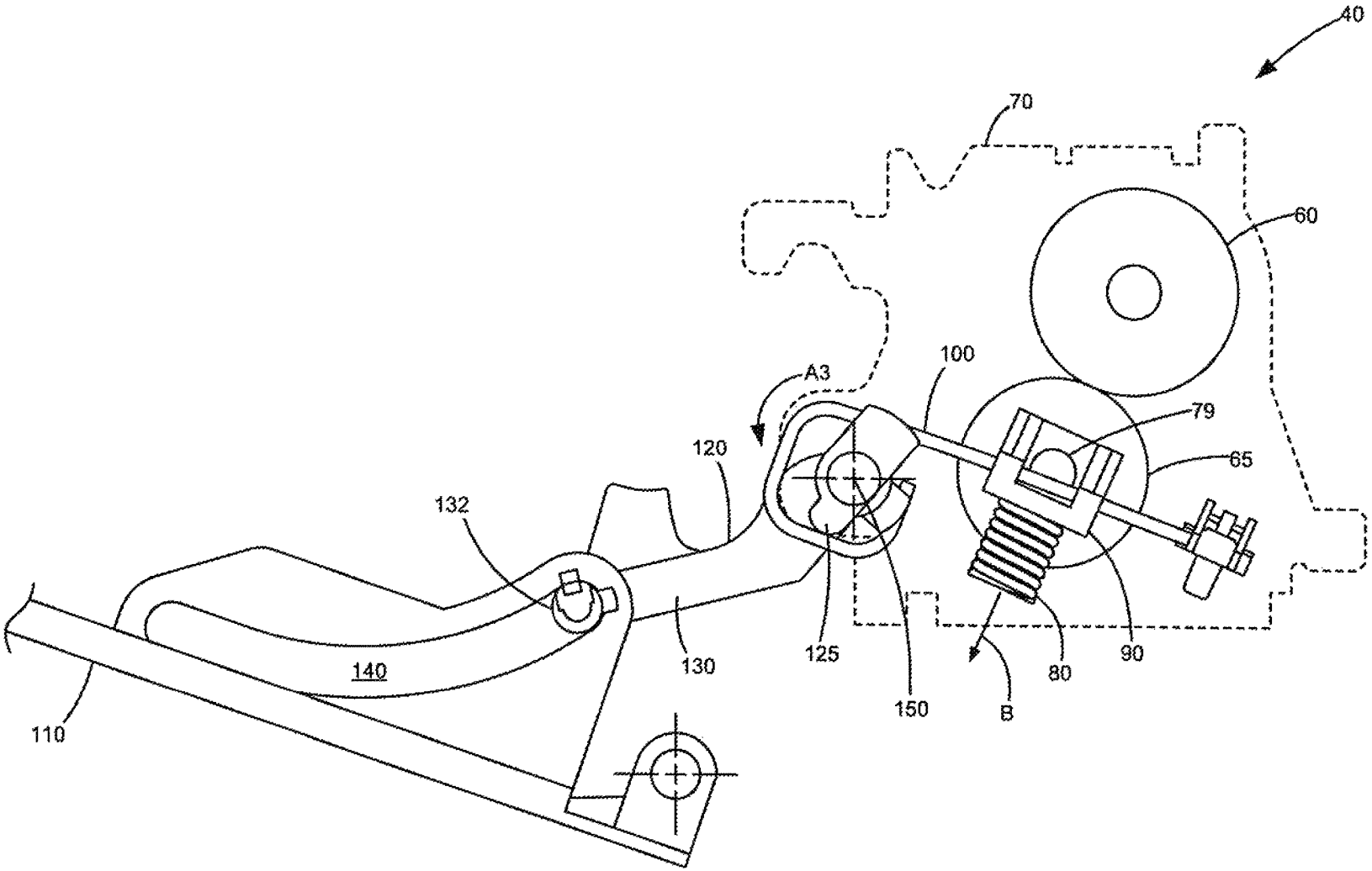

The bellcrank 100, in the form of a wire, has its terminal end 108 anchored to the housing 70 of the fuser assembly while its other end 112 attaches to a cam arm assembly 120. The wire remains generally stationary until the cam arm assembly moves with movement of the access door 110 from a closed position (FIG. 3A) to an open position (FIG. 3C). The wire end 112 forms a bent loop 114 about a cam 125 of the cam arm assembly. In turn, the arm 130 of the cam arm assembly has a protrusion 132 that is guided in slots 140 of the access door 110. When the door 110 is fully closed, the wire and cam do not contact one another (FIG. 3A). Upon movement of the door 110 from its fully closed position to an intermediate position (FIG. 3B), the slots 140 rotate in the direction of Action Arrow A1. This pulls downward the arm 130 of the cam arm assembly 120 and causes the cam 125 to rotate about its axis 150 in the direction of the movement of the door, e.g., in the direction of action arrow A2. In turn, the cam 125 contacts the loop end of the bellcrank 100 at position B and acts to rotate downward the bellcrank 100, thus compressing from above the nip loading spring 80 at the fitting 90. With further movement of the access door 110 to its fully open position (FIG. 3C), the cam 125 rotates further about its axis 150 in the direction of Action Arrow A3 thereby exerting even more force on the bellcrank 100, thus levering further the nip loading spring 80 in the direction of Action Arrow B.

Figure 4A:
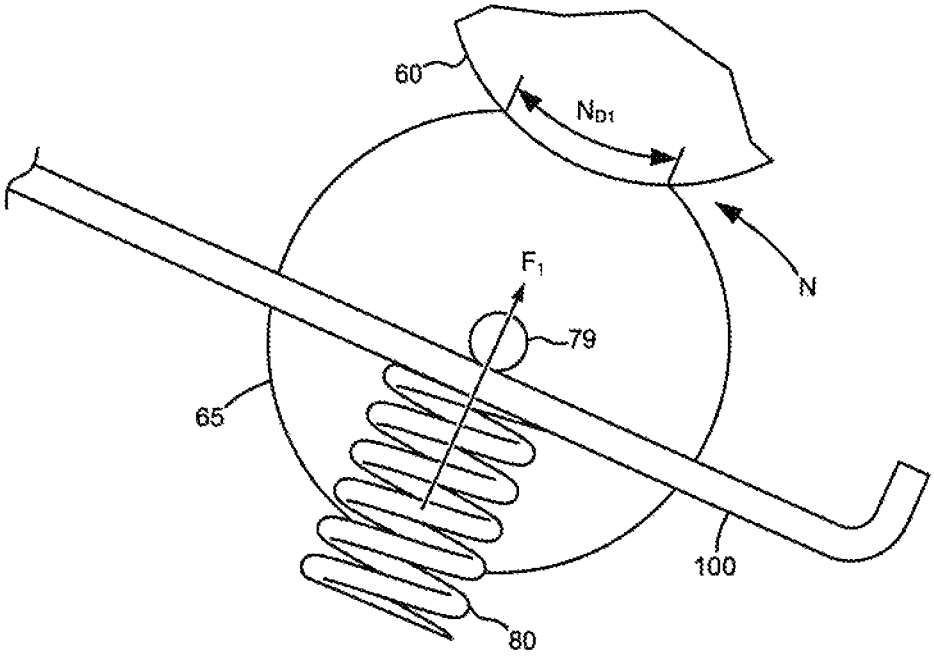
FIGS. 4A and 4B are diagrammatic views of the fusing nip with forces acting thereon.
Figure 4B:
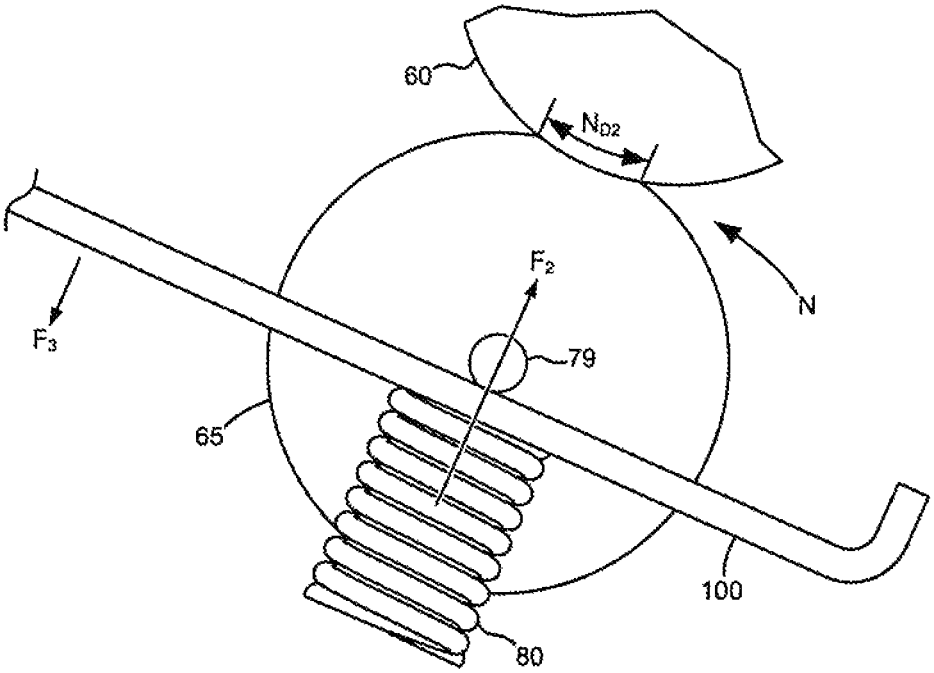
Figure 5:
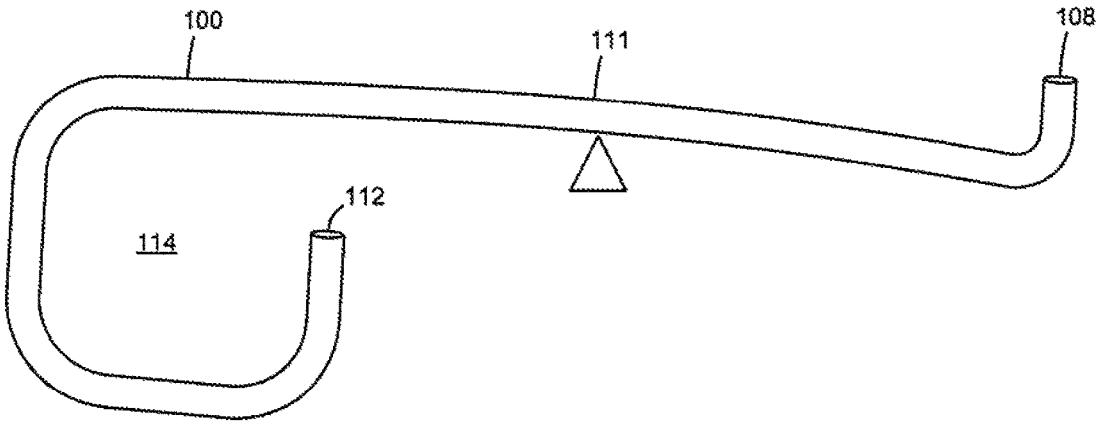
FIG. 5 is a diagrammatic view of a representative bellcrank.

As seen by comparing the greatly simplified diagrams of FIGS. 4A and 4B, the fusing nip N formed between the heated member 60 and 65 changes in force upon activation of the bellcrank 110 upon the opening of the access door. In FIG. 4A, when the access door is closed, the bellcrank 110 does not force downward the nip loading spring 80 and a first force F1 is exerted by the spring 80 on the shaft 79 of the backup member 65. In FIG. 4B, when the access door is open, the cam arm assembly causes the bellcrank 110 to lever downward with a force F3 and compress the nip loading spring 80. In turn, the nip loading spring 80 exerts a second force F2 less than force F1 (F2<F1) on the shaft 79 of the backup member 65. This lessens the fusing nip force on media traveling through the fusing nip and also decreases the nip distance of travel from ND1 in the first instance to ND2 in the second instance (ND2<ND1). Wrinkling is avoided when imaging media, such as envelopes With reference to FIG. 5, a representative bellcrank 100 includes a wire, such as music wire, having a diameter in a range from about 1-2 mm. Its working length extends in a range from about 60-70 mm. A distance also extends in a range from about 20-30 mm from the anchored terminal end 108 to a location 111 where the bellcrank acts on top of the nip loading spring. Of course, other flexible levers could serve as a bellcrank meeting the functions described herein.

The foregoing illustrates various aspects of the invention. It is not intended to be exhaustive. Rather, it is chosen to provide the best mode of the principles of operation and practical application known to the inventor so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. A fuser assembly for an imaging device having an access door, comprising:

a heated member;

a backup member;

a nip loading spring biased to press into contact the backup member and the heated member to form a fusing nip at which toner becomes fused to media during an imaging operation; and a bellcrank positioned in contact with the nip loading spring such that upon opening the access door, the bellcrank acts on the nip loading spring to reduce a force between the backup member and the heated member but keeping in contact the backup member and the heated member by way of the force from the nip loading spring.

2. The fuser assembly of claim 1, wherein the bellcrank includes a wire.

3. The fuser assembly of claim 2, wherein the wire is cylindrical and as a diameter in a range from about 1-2 mm.

4. The fuser assembly of claim 2, wherein the wire is anchored at a terminal end to pivot downward to compress the nip loading spring upon the opening of the access door.

5. The fuser assembly of claim 2, wherein the wire extends in length for about 60-70 mm.

6. The fuser assembly of claim 1, further including a cam configured to act upon the bellcrank only upon the opening of the access door.

7. The fuser assembly of claim 6, further including an arm contacting the cam, the arm to be guided in slots of the access door from a closed to an open position, the cam pivoting about an axis during movement of the access door from the closed to the open position.

8. The fuser assembly of claim 6, wherein the bellcrank includes a wire with a loop end bent about the cam, the cam contacting the loop end only upon the opening of the access door.

9. The fuser assembly of claim 1, wherein the backup member has a shaft defining an axis of rotation, the nip loading spring exerting a biasing force on the shaft to press the backup member into contact with the heated member.

10. The fuser assembly of claim 9, further including a second nip loading spring and a second bellcrank, the second nip loading spring positioned to exert a second biasing force on a distal end of the shaft to press the backup member into contact with the heated member, the second bellcrank positioned in contact with the second nip loading spring such that upon the opening of the access door the second bellcrank acts on the second nip loading spring to reduce the second biasing force but keeping in contact at the distal end the backup member and the heated member by way of the second biasing force.

11. An imaging device for imaging sheets of media, comprising:

a door providing access to an interior of the imaging device; and a fuser assembly located in the interior to fuse toner to the sheets of media during use, the fuser assembly having, a heated member, a backup member with a shaft defining an axis of rotation, two nip loading springs biased on either side of the shaft to press into contact the backup member and the heated member to form a fusing nip, and two bellcranks, one each positioned in contact with either of the two nip loading springs, the two bellcranks being further connected to the door such that upon opening of the door, the two bellcranks compresses the two nip loading springs to reduce a force between the backup member and the heated member but keeping in contact with one another the backup member and the heated member by way of the force from the two nip loading springs.

12. The imaging device of claim 11, the door further including two guide slots.

13. The imaging device of claim 12, further including two cams, each of the two cams acting on either of the two bellcranks upon the opening of the door.

14. The imaging device of claim 13, wherein the two bellcranks are wires have a loop end configured about either of the two cams.

15. The imaging device of claim 14, further including two arms, each of the two arms connecting to said either of the two cams, said each of the two arms to be guided in one of the two guide slots of the door as the door transitions from a closed to an open position, said each of the two cams pivoting about an axis during movement of the door from the closed to the open position and acting on either of the loop ends.

16. The imaging device of claim 11, wherein the two bellcranks are wires anchored to a housing of the fuser assembly.

17. The imaging device of claim 16, wherein the wires extend above the two nip loading springs.

18. A fuser assembly for an imaging device, comprising:

a first and second roll forming a fusing nip at which toner becomes fused to media during an imaging operation in the imaging device;

a nip loading spring biased to force contact between the first and second rolls; and a flexible lever positioned in contact with the nip loading spring to change a first force between the first and second rolls to a second force less than the first force upon movement of the flexible lever but keeping in contact with one another the first and second rolls by way of the nip loading spring, wherein the flexible lever connects to an access door of the imaging device and movement of the access door from a closed to an open position causes the movement of the flexible lever.

19. The fuser assembly of claim 18, wherein the flexible lever is positioned above the nip loading spring to compress the nip loading spring to reduce the bias the nip loading spring exerts on the first and second rolls of the fusing nip during movement of the flexible lever from the closed to the open position of the access door.

* * * * *